United States Patent [19]

Joslyn

[11] 3,974,731

[45] Aug. 17, 1976

[54] MUSICAL TOY

[76] Inventor: John Joslyn, Rayview Ave., Sag Harbor, Long Island City, N.Y. 11963

[22] Filed: Dec. 30, 1974

[21] Appl. No.: 537,260

[52] U.S. Cl. ..... 84/404; 46/118; 46/191

[51] Int. Cl.[2] ..... G10D 13/08

[58] Field of Search ..... 46/236–238, 46/116–118, 174, 175 R, 177, 189, 191; 84/404, 402, 403, 405, 102

[56] References Cited

UNITED STATES PATENTS

| | | | |
|---|---|---|---|
| 859,620 | 7/1907 | Sandell | 84/102 |
| 2,097,823 | 11/1937 | Roe | 84/405 X |
| 2,541,143 | 2/1951 | Zimmerman | 84/404 |
| 2,647,430 | 8/1953 | Schilling | 84/405 |
| 2,788,608 | 4/1957 | Anthony | 84/404 X |
| 3,118,423 | 1/1964 | Schmid | 84/404 X |

*Primary Examiner*—John Gonzales
*Attorney, Agent, or Firm*—Arthur T. Fattibene

[57] ABSTRACT

A musical device which comprises a base member on which a plurality of musical tone bars are mounted. A hammer is resiliently mounted in striking relationship with each of the respective tone bars, and an actuator is moveably mounted opposite the respective hammer. The actuator and associated hammers include complementary magnetic material so that an alternating magnetic field resulting from the movement of the actuator relative to the hammer causes movement of the associated hammer to strike the respective tone bars accordingly. In doing so, an extremely pleasing and unusual musical tone is produced.

9 Claims, 4 Drawing Figures

MUSICAL TOY

PROBLEM AND PRIOR ART

Heretofore various types of musical toys have been made. Of the type utilizing tone bars, various mechanical means have been used to strike the tone bars in a predetermined sequence to produce musical sounds. The simplest of such toys included a hand held hammer which the child would manually strike on a given tone bar in a simple xylophone manner. The more complex tone bar musical toys utilized complex mechanical linkage arrangements and/or relative complex electric solenoid actuated hammers which were responsive to the actuation of a particular key or button. These latter constructions are relatively costly and complex to manufacture, and produce a sound or note of conventional quality.

OBJECTS

An object of this invention is to provide a musical toy which is relatively simple in construction, inexpensive to manufacture, and which is safe in use.

Another object is to provide a musical toy which has an interesting and mystifying visual effect in addition to a pleasing and amusing audio response.

Another object is to provide a musical toy which is constructed and arranged to provide an unusual sound effect which is pleasing and amusing to the young.

BRIEF SUMMARY OF INVENTION

The foregoing objects and other features and advantages are attained by a musical toy having a plurality of tone bars mounted on a suitable base member. A hammer is resiliently mounted adjacent a corresponding tone bar in striking relationship therewith. In accordance with this invention, there is provided a moveable actuator which includes a magnetic material located in the respective hammers. The arrangement is such that movement of the actuator creates an alternating or periodic magnetic field to periodically attract or repel the associated hammer to result in a striking of a corresponding tone bar. The tone bars and hammers may be totally enclosed within a transparent housing for added safety and appeal.

In one form of the invention, the actuator may comprise rotatably mounted wheels or roller means which have one or more magnetic pieces of material circumferentially spaced about the periphery thereof. The rotation of such actuators generates a variable or periodic magnetic field which influences the corresponding hammers to strike the tone bars accordingly. It has been discovered that speed of rotation of the wheel and the frequency at which the magnetic material passes by the hammer results in the production of an extremely pleasing and unusual sound.

In another form of the invention, a slide actuator may be substituted in lieu of the rotatable wheels means, whereby movement of the slide transversely of the respective hammer effects the striking of the tone bars accordingly.

FEATURES

A feature of this invention resides in the provision of a musical toy having hammers that are resiliently supported and which are actuated by a magnetic field or influence.

Another feature of this invention resides in a musical toy in which the hammer for striking the tone bars to produce various musical notes are magnetically actuated.

Another feature resides in forming the hammers in the shape of animated objects and magnetically actuating the hammers to provide for visual, as well as musical appeal.

Another feature resides in the provision wherein the hammers and tone bars can be wholly encased to provided for added safety, while permitting the child to selectively actuate the respective hammers to produce the desired sound effects.

Other features and advantages will become more readily apparent when considered in view of the drawings and specification in which.

DETAILED DESCRIPTION

Figure 2:
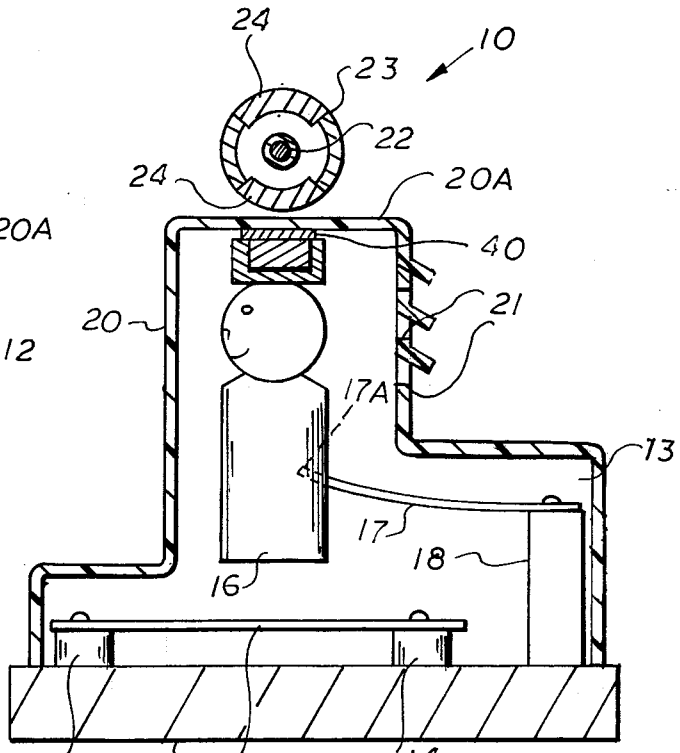
FIG. 2 is a sectional view taken along line 2—2 on FIG. 1.
Figure 1:
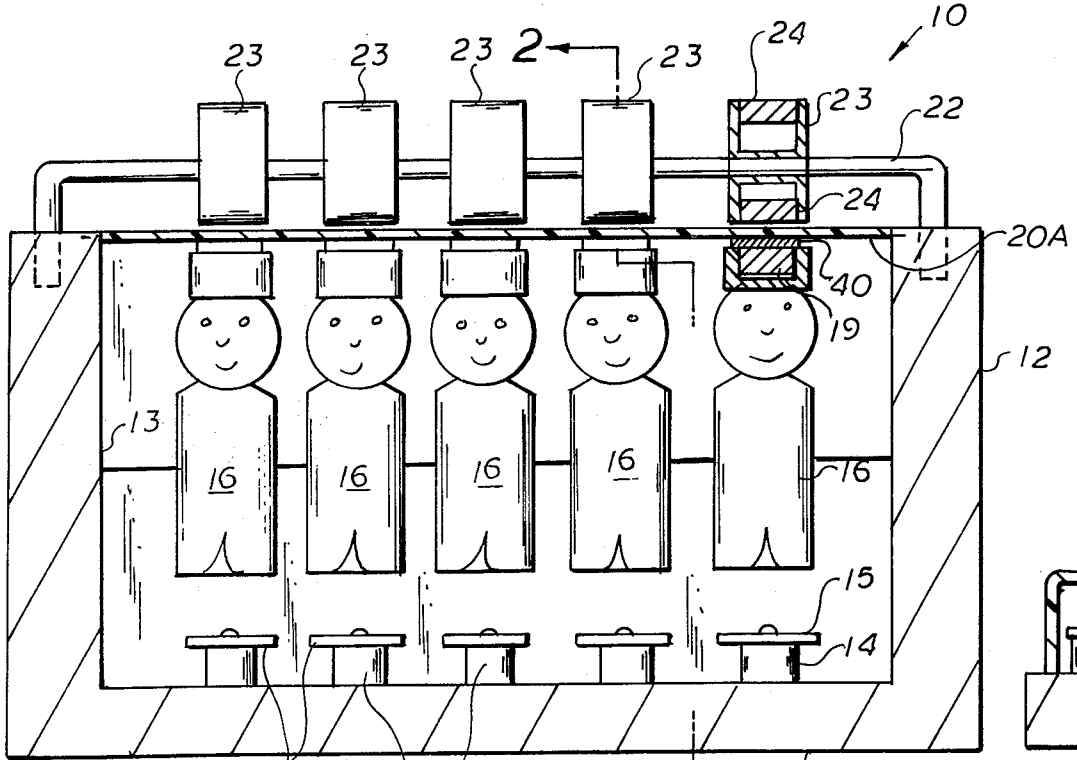
FIG. 1 is a longitudinal sectional view of a musical device embodying the invention.

Referring to the drawings, there is shown in FIGS. 1 and 2 a musical toy device 10 embodying the present invention. As shown, the musical toy device 10 comprises a base member 11 having connected opposed end wall portions 12 and 13. Mounted on the base member 11 on suitable end supports 14—14 are a plurality of tone bars 15. It will be understood that the respective tone bars 15 are constructed to sound a particular note or sound.

Cooperatively associated with each of the respective tone bars 15 is a hammer 16. As shown, each hammer 16 is resiliently supported in striking relationship to a tone bar 15 by means of a resilient spring member 17; e.g., a plastic or metal flat spring. In the illustrated embodiment one end of the spring 17 is connected to a spring support 18 mounted to the base member 11. The respective hammers 16 in turn are connected to the free end 17A of the respective resilient spring 17 so as to be in striking relationship with an associated tone bar 15. For added appeal to a small child, the respective hammers are formed in the shape of an animated object to enhance both visual appeal and to increase play value of the musical device, as will be hereinafter more fully set forth. The respective hammers 16 are illustrated as being formed in the shape of little people or toy soldiers.

In accordance with this invention, a magnet or magnetic attractive material 19 is located in the top portion of the respective hammers 16. If desired, the tone bars 15 and associated hammers 16 can be completely enclosed or encased within a housing enclosure 20 which extends between the end walls 12 and 13. When the housing enclosure is used, suitable openings 21 are provided in a wall portion thereof to permit the sound of the tone bars to eminate from the housing during the play thereof.

Above the end walls 12 and 13 and above the enclosure 20 is a shaft or bar 22 on which there is rotatably journalled a plurality of actuating wheels or rollers 23. In the illustrated form of the invention, the actuator wheels or rollers 23 are each shown as hollow structure which have circumferentially spaced about the periphery internally thereof one or more pieces of magnetic material; e.g., a permanent magnet 24. As seen in FIG. 2, two such magnets 24 are oppositely disposed about the periphery of the respective wheels; e.g., in 180° relationship. The diameter of the respective actuator roller or wheel 23 is such that the outer circumference or surface thereof is disposed contiguous or closely adjacent to the upper portion 20A of the housing 20.

As seen in FIG. 2, the weight of the magnetic material 24 within the wheel or roller 23 will normally maintain the magnetic material closely adjacent the housing, thereby exerting a magnetic influence on the magnetic material 19 contained with the top of the respective hammers. In the event mutually attractive magnetic pieces 19 and 24 are employed, the respective hammers 16 are magnetically attracted to the actuating wheels 23, as indicated in FIGS. 1 and 2, in the normal inactive position of the device 10.

To effect the operation of the device 10, a child would merely spin the respective actuating wheels or rollers 23 in any desired sequence. In doing so, the revolution of the wheel 23 will create an alternating or periodic magnetic field to alternately attract or repel the hammers accordingly. Under the influence of the changing magnetic field as the rollers 23 rotate cause the respective hammers to be displaced and strike the tone bar 15. It is to be understood that the resilient spring 17 supporting the respective hammers 16 should be sufficiently resilient so that the influence of the magnetic field created between the actuating wheel and the hammer will effect the displacement of the hammer sufficiently to strike the associated tone bar 15. It will be understood that the magnetic material on the wheel 23 and in the respective hammers 16 may be of the type that are mutually attracted to one another; or conversely, that repel one another. In either event, the changing magnetic field as the roller rotates will effect the displacement of the respective hammer accordingly. The utilization of more that one magnetic 24 circumferentially spaced about the actuating wheel results in a multiple beat per one revolution of the wheel or roller 23. Such multiple beat per revolution creates an extremely pleasing and unusual sound; and by simultaneously activating two or more rollers, an interesting overlapping attenuating sound is produced. Thus varying the notes of the respective tone bars, and by sequencing the actuation of the respective actuator wheels, various musical sounds can be produced thereby.

Where the tone bars 15 are formed to represent the various notes of a musical scale, the device can be used to play a musical song. To facilitate a child to play a given song on the described musical toy 10, the respective wheels or actuators 23 can be color coded to the notes on a particular song card. In this manner a small child can play a tune simply by rotating the color wheel 23 corresponding to a similar colored note on a given song chart.

The enclosure 20 is preferably formed of a transparent material; e.g., a clear plastic. Thus in forming the hammers 16 in the shape of an animated object and by effecting the rotation of the wheel 23 in a predetermined sequence, the musical device 10 is provided with both visual appeal as well as musical appeal to thereby enhance the overall play value of the musical device. In addition the actuation of the respective hammer under the influence of a changing magnetic field imparts additional mystery to a small child which greatly adds to the overall play value of the toy 10.

Figure 4:
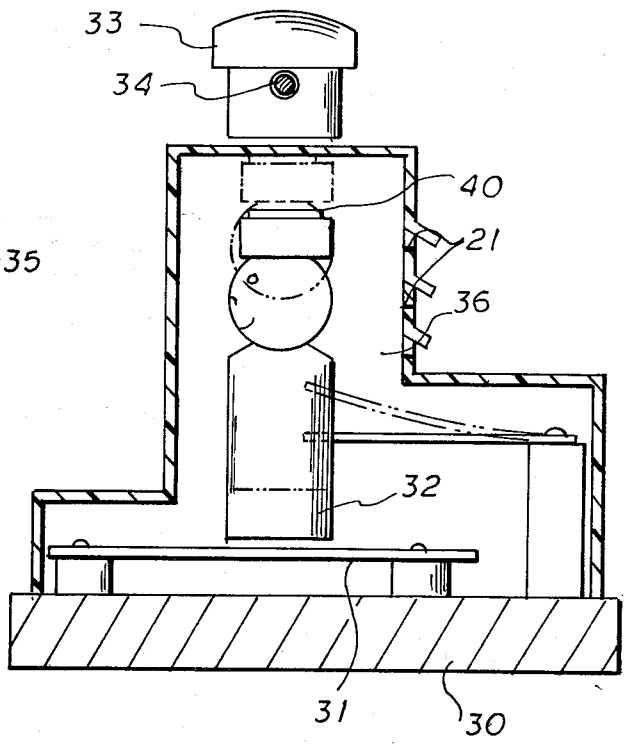
FIG. 4 is a sectional view of the modified embodiment taken along line 4—4 on FIG. 1.
Figure 3:
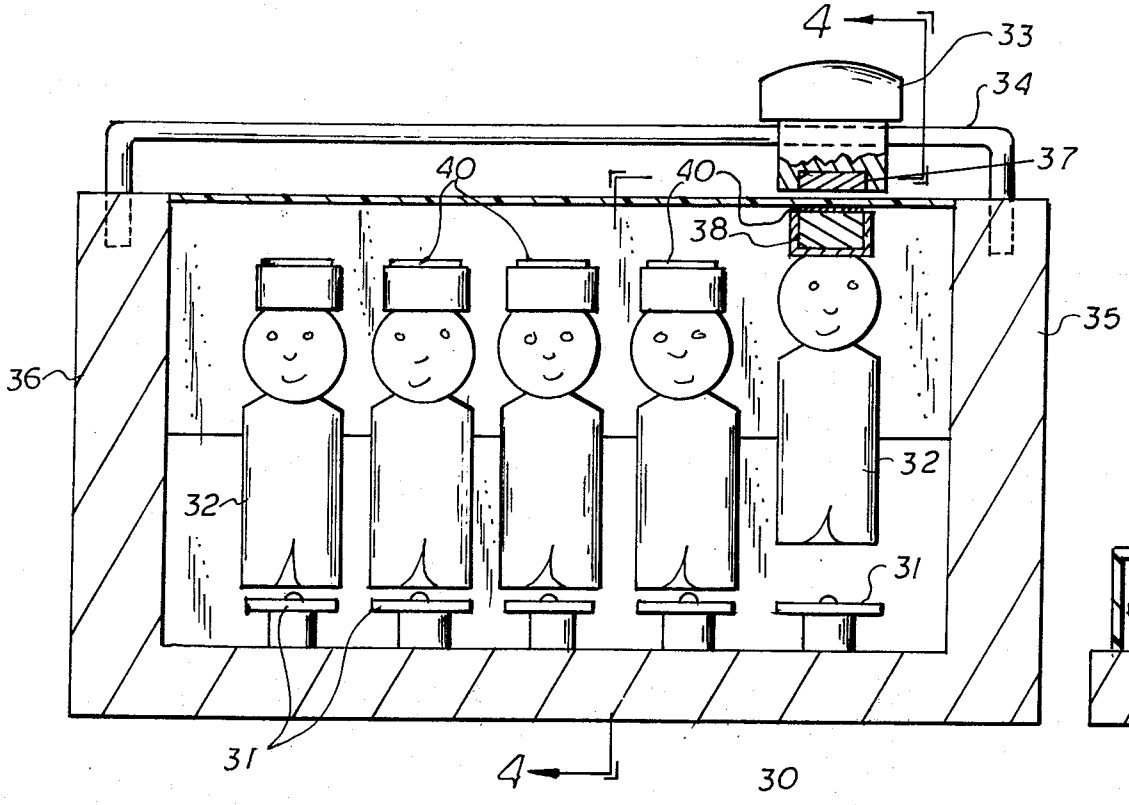
FIG. 3 is a longitudinal view of a modified embodiment.

FIGS. 3 and 4 illustrate a modified form of the invention. In this form of the invention, the base member 30, tone bar 31, and hammers 32 construction is similar in all respects to that hereinbefore described. However, in this form of the invention, the actuating means for for the respective hammers 32 comprise a slider 33 which is slideably mounted on a slide bar 34 which extends between the end walls 35, 36 of the base member. The slide member 33 incorporates therein a magnetic material, e.g., a magnet 37 which complements the magnetic material 38 located in the top of the respective hammers 32. In this form of the invention, it is to be noted that the hammers 32 are selectively actuated by sliding the magnetic slider 33 back and forth across the slide bar 34. In doing so, the respective hammer which is brought under the influence of the magnetic field of the slider as the slide is moved pass the hammer will be caused the same to be displaced thereby striking the associated tone bar 31.

In all other respects the construction of FIGS. 3 and 4 is similar to that described with respect to FIGS. 1 and 2.

In both of the described embodiments, a resilient pad, e.g., a piece of felt 40 or the like may be located on the top of each hammer so as to silence any impact which may occur between the hammer and the top of the housing during operation.

The musical toy described thus provides for a relatively simple and amusing toy wherein the hammer and associated tone bars can be completely encased for added safety and whereby the operation of the device is such as to enhance both the visual appeal as well as the musical appeal. The magnetic field in effecting actuation of the hammer further creates a mysterious effect for a young child which results in greatly enhancing the play value of the overall toy 10.

It will be understood that the magnetic material 24 or 37 of the actuator 23 or 33, and the magnetic material 19 or 38 of the hammer may each consist of a permanent magnet or one may be a permanent magnet and the other a suitable metal or piece which can be attracted or repelled by the permanent magnet Also the respective magnets located in the actuator and the hammer can be disposed so that the adjacent poles may be of the same or opposite polarity.

While the present invention has been described with respect to several embodiments thereof, it will be readily appreciated and understood that variations and modifications may be made without departing from the spirit or the scope of the invention.

What is claimed is:

1. A musical toy comprising:

a base member, a plurality of tone bars mounted on said base member, a hammer disposed in striking relationship to each of said tone bars, means for resiliently supporting each of said hammers in striking relationship to its corresponding tone bar for movement toward and away from said corresponding tone bar, an actuator means moveably mounted adjacent said hammers, said actuator means and hammers including complementary magnetic means which when the actuator means is moved relative to said hammer means creates a magnetic influence on the adjacent hammer which causes the hammer to strike its corresponding tone bar, wherein said actuating means includes a slide bar mounted on said base member in spaced relationship to said hammers, and a slider slideably mounted on said slide bar for movement transversely relative to said hammers whereby said hammers are sequentially actuated as said slider slides pass said hammers.

2. The invention as defined in claim 1 and said complementary magnetic means including a magnet imbedded in said slider, and each of said hammers having a magnetic element connected thereto.

3. The invention as defined in claim 2 wherein each of said hammers simulates an animated form.

4. A musical toy comprising:

a base member, a plurality of tone bars mounted on said base member, a hammer disposed in striking relationship to each of said tone bars, means for resiliently supporting each of said hammers in striking relationship to its corresponding tone bar for movement toward and away from said corresponding tone bar, an actuator means moveably mounted adjacent said hammers, said actuator means and hammers including complementary magnetic means which when the actuator means is moved relative to said hammer means creates a magnetic influence on the adjacent hammer which causes the hammer to strike its corresponding tone bar, wherein said actuating means includes an actuating wheel rotatably journalled above the respective hammers, said complementary magnetic means being connected to said wheel and associated hammer whereby rotation of said wheel effects an alternating magnetic influence on said hammer whereby said hammer repeatedly strikes its associated tone bar as said wheel rotates.

5. A musical toy comprising a base member, a series of tone bars mounted on said base member, a hammer disposed over each of said tone bars, a resilient spring member supporting each of said hammers in striking relationship to its respective tone bar, a housing enclosure connected to said base member for encasing said tone bars and associated hammer within said enclosure, a slide bar mounted on said housing enclosure so as to be disposed exteriorly thereof, said slide bar extending transversely of said hammers, a slider slideably mounted on said slide bar whereby said slider is rendered freely moveably along said slide bar, a magnet carried on said slider, a magnetic attractive material located on each of said hammers, said magnet exerting a magnetic field over said hammers to effect displacement of said hammer in sequence as said slider is moved along said slide bar whereby the displacement of said hammers result in a striking of the associated tone bars to sound a musical note.

6. The invention as defined in claim 5 and including a resilient pad connected to the top of each hammer.

7. A musical toy comprising:

a base member having connected end walls, a shaft extended between said end walls in spaced relationship to said base member, a plurality of tone bars mounted on said base member, l a hammer operatively associated with each of said tone bars, spring means for resiliently supporting each of said hammers in striking relationship with corresponding tone bars, a plurality of actuating rollers rotatably journalled on said shaft, said rollers being disposed opposite a corresponding hammer, complementary magnetic means carried on each of said actuating rollers and associated hammers whereby rotation of said rollers effects an alternating magnetic influence on the associated hammers to effect a periodic displacement thereof to result in a striking of said tone bars accordingly.

8. The invention as defined in claim 7 wherein said actuating rollers include a plurality of magnetic means circumferentially spaced about the periphery of said rollers.

9. The invention as defined in claim 7 and including a housing enclosure extended between said end walls for encasing said hammers and tone bars within said enclosure.

* * * * *